US006209780B1

(12) United States Patent
Jensen

(10) Patent No.: US 6,209,780 B1
(45) Date of Patent: Apr. 3, 2001

(54) QUIZ GAME FRENCH FRY SCOOP

(76) Inventor: Kurt Jensen, 189 Summit St., Lebanon, OH (US) 45036

( * ) Notice: Subject to any disclaimer, the term of this patent is extended or adjusted under 35 U.S.C. 154(b) by 0 days.

(21) Appl. No.: 09/364,936

(22) Filed: Jul. 30, 1999

(51) Int. Cl.[7] ..... B65D 5/00

(52) U.S. Cl. ..... 229/103; 229/400; 229/161.1; 229/118; 206/459.5

(58) Field of Search ..... 229/400, 118, 229/161.1, 103; 206/459.1, 459.5, 158; 273/139, 293; 383/903, 65, 56; 40/490, 491

(56) References Cited

U.S. PATENT DOCUMENTS

| | | | | |
|---|---|---|---|---|
| 276,191 | * | 4/1883 | Mendum et al. | 40/490 |
| 1,506,067 | * | 8/1924 | Lamb | 40/491 |
| 1,544,463 | * | 8/1925 | Lengsfield | 40/490 X |
| 2,635,356 | * | 8/1953 | Drury | 40/490 |
| 2,644,632 | | 7/1953 | Claff . | |
| 2,974,433 | * | 3/1961 | Litzinger | 434/172 X |
| 3,207,411 | | 9/1965 | Farguhar . | |
| 3,251,152 | | 5/1966 | Takefman . | |
| 4,011,985 | * | 3/1977 | Simson | 229/68.1 |
| 4,108,350 | | 8/1978 | Forbes . | |
| 4,206,869 | | 6/1980 | Gurevitz . | |
| 4,330,060 | | 5/1982 | Thornton . | |
| 4,403,689 | | 9/1983 | Wood . | |
| 4,453,664 | | 6/1984 | Oliff . | |
| 4,461,497 | | 7/1984 | Downey . | |
| 5,697,546 | | 12/1997 | Yocum . | |
| 5,966,887 | * | 10/1999 | Cai et al. | 229/400 |
| 6,047,881 | * | 4/2000 | Clements et al. | 229/116.1 |
| 6,068,181 | * | 3/2000 | Cai | 229/116.1 |

* cited by examiner

*Primary Examiner*—Allan N. Shoap
*Assistant Examiner*—Tri M. Mai

(57) ABSTRACT

An otherwise conventional paperboard french fry scoop and container is provided with a game or quiz accessory construction to improve its utility. The rear (higher) wall (16) of the scoop is provided with a pair of parallel slits (24, 26) which slidably receive a tear off strip (62), the latter carried by a glue panel (50) glued to the rear wall of the scoop. The tear strip carries indicia (66, 68) in the form of two rows of respective questions and answers, the indicia being viewed through openings (28, 30) between the two slits. The user tears off the tear strip, inserts it through the slits, and proceeds to read the questions and answers. All components of the scoop are readily formed from the blank, the mode of assembling the device, as well as the basic form of the unitary paperboard blank from which it is formed, being essentially the same as that of known paperboard french fry scoops. In a second embodiment, the parallel slits and openings are located in the front wall (32), and the tear strip (620) is integral with and detachable from the rear or higher wall (16).

9 Claims, 5 Drawing Sheets

QUIZ GAME FRENCH FRY SCOOP

BACKGROUND OF THE INVENTION

This invention relates to a french fry scoop of the type fashioned from a unitary blank of paperboard or other stiff, resilient, and foldable sheet material.

The container art is aware of a number of french fry scoop and container constructions, typically fashioned from paperboard, and including a front wall, a rear or scoop wall, and a bottom wall. The scoop wall usually rises higher than the front wall, while the front wall is typically provided with a part circular recess at its central portion. The front and rear walls are curved to yield a container generally convex in transverse cross section, as a convex—convex optical lens. Such scoops are shipped to a fast food outlet in flattened or collapsed condition, and the scoop is opened or erected by manually pressing its opposite edges together, with the bottom wall construction being such that a toggle action is effected to thereby lock the container in an open position due to the inherent resiliency of paperboard. While in this open position, a server will typically hold the container by its side edges and use the protruding rear wall portion as a scoop to fill the container with french fries. Then, the filled scoop is served to the consumer. The french fry container/scoop construction described above is known.

SUMMARY OF THE INVENTION

According to the practice of this invention, the rear or scoop wall is provided with two parallel slits, each extending completely through the paperboard or other sheet material. Each of a pair of vertically and horizontally displaced openings passes completely through the paperboard. These openings are located between the parallel slits. The rear wall of the container carries a tear-off strip, the strip being of generally uniform width, with the width of the tear strip being slightly less than the length of the two parallel slits. The tear-off strip is provided on one of its surfaces with two lines or rows of indicia, with one line of indicia defining separate and distinct questions and the other line defining separate and distinct answers to the questions. In use, the consumer, typically after having eaten the french fries, tears off the tear strip and inserts it through the two parallel slits. Insertion is done in such a manner that the indicia is viewable through the two openings. For example, one of the openings may display a question, while the other opening may display the answer to that question. In a second embodiment, the slits and openings are located on the front wall, while the tear strip is formed by tearing out a pre-weakened portion of the rear or scoop wall.

DETAILED DESCRIPTION OF THE INVENTION

Figure 1:
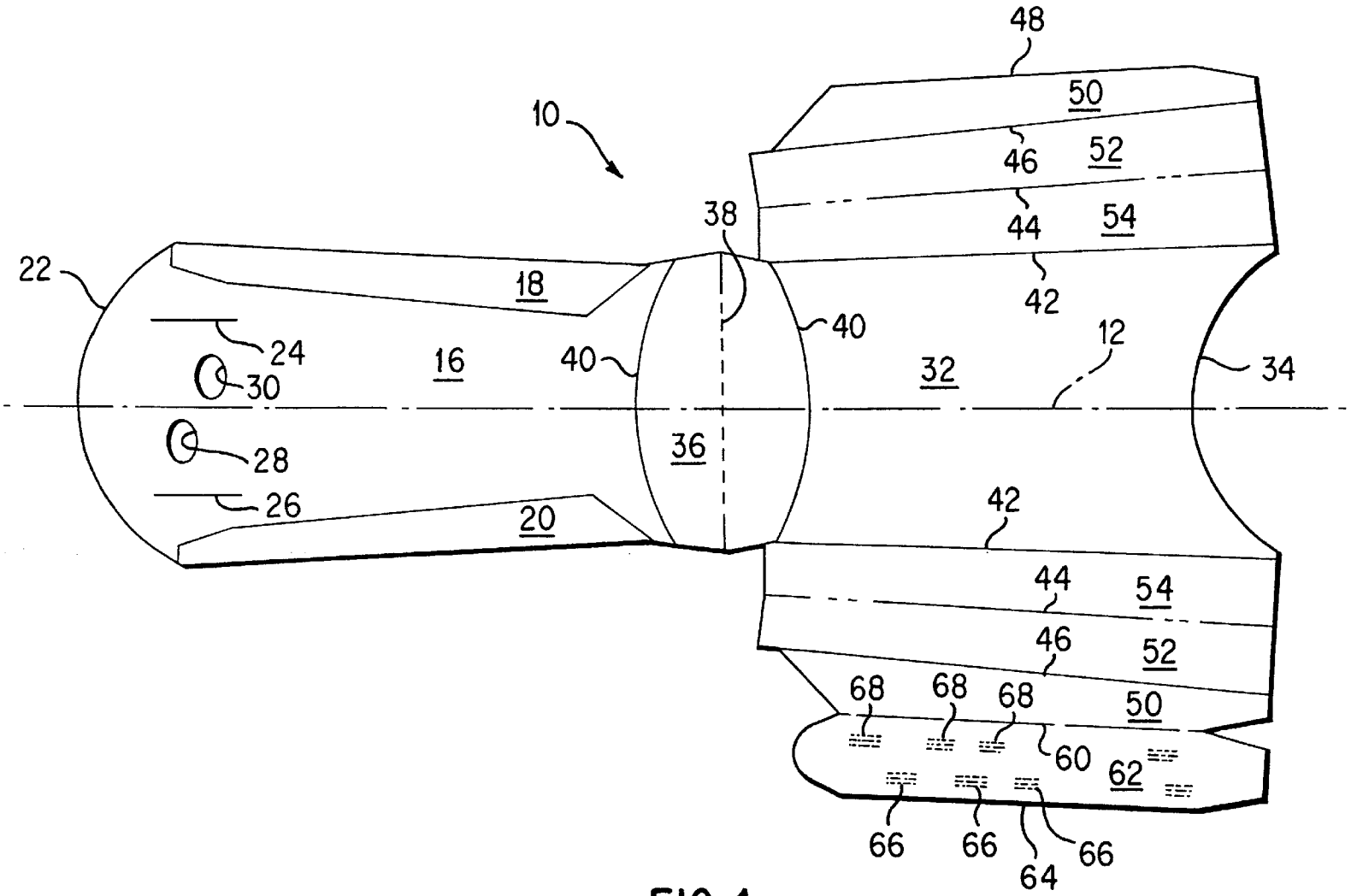
FIG. 1 is a plan view of a unitary blank of paperboard or other stiff, resilient, and foldable sheet material for forming the french fry scoop of this invention.

Referring now to FIG. 1 of the drawings, a unitary blank of paperboard is denoted as 10, with the blank having an imaginary longitudinal axis 12 dividing it into upper and lower regions (shown in FIG. 1 as left and right regions). The rear wall panel 16, of generally elongated form and having glue receiving areas 18 and 20, is generally elongated and slightly tapered. Numerals 24 and 26 denote, respectively, parallel slits extending completely through the paperboard, with openings 28 and 30 located between slits 24 and 26. It will be observed that openings 28 and 30 are both vertically and horizontally spaced from each other. A bottom forming panel 36 is integrally connected with panel 16, with bottom panel 36 having a vertically running, central fold line 38. The right and left sides of bottom panel 36 each carry a curved fold line 40.

The right portion of the blank (vertical when the blank is erected) carries a front wall forming panel 32, with this panel having a plurality of fold lines 42, 44, 46, and an edge 48. These fold lines and edge define panels 50, 52, and 54.

The lower portion of lower panel 50 is provided with a perforated tear line 60. Line 60 and lower edge 64 define between them a tear strip 62. This tear strip is provided with two generally horizontal rows or lines of indicia 66 and 68. It will be noted that each row 66, 68, has a plurality of spaced indicia sub-groups, the latter representing questions and respective answers, for example. The width of panel 62 is slightly less than the length of slits 24 and 26.

For assembly of the scoop from the blank, the upper half (right half of FIG. 1) of the blank is folded about fold line 38, with panel 32 swung down adjacent to the plane of panel 16, then pressing panels 50 onto respective adhesive areas 20 and 18 by folding along fold lines 44.

Figure 2:
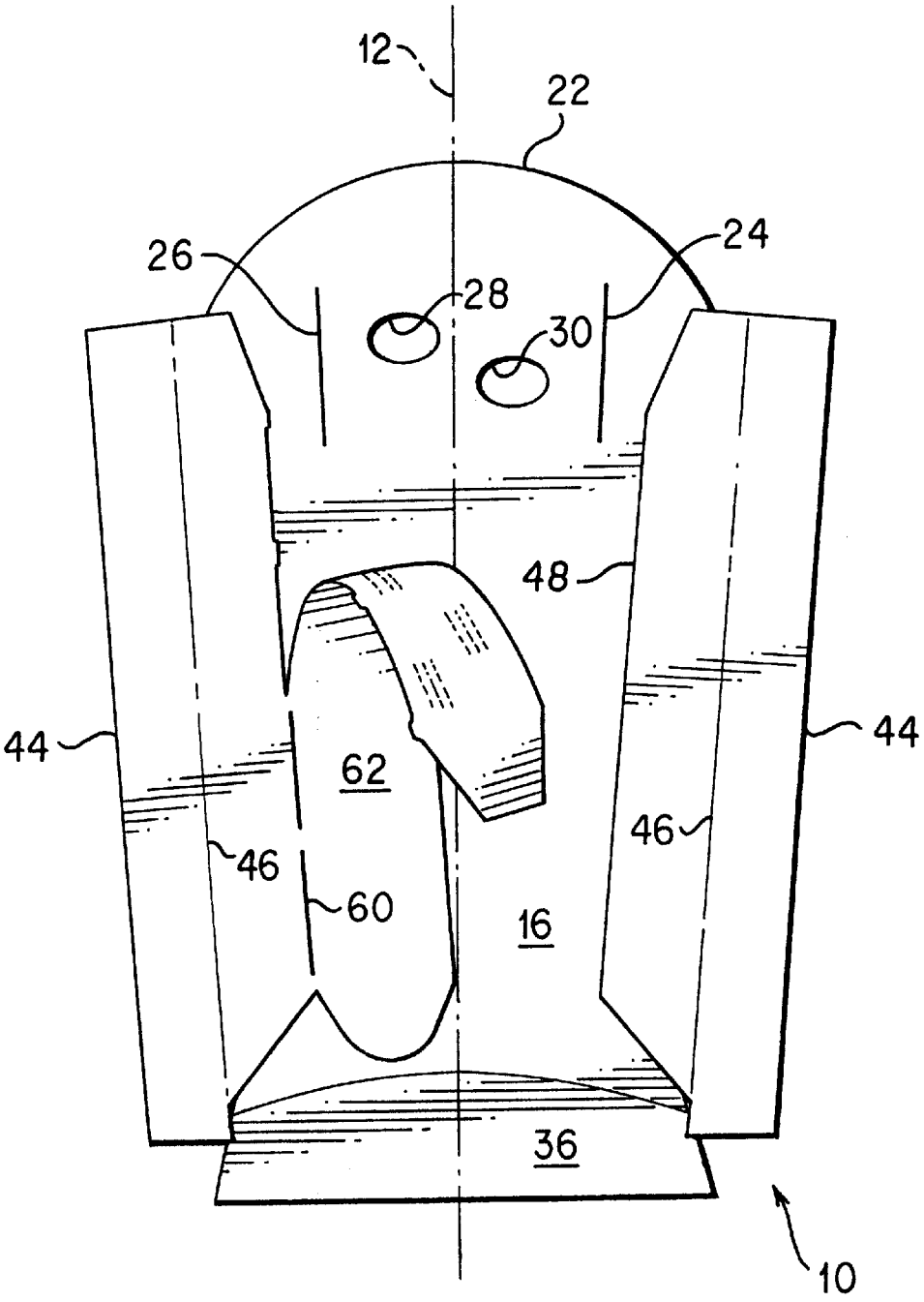
FIG. 2 is a rear elevational view illustrating the french fries container of this invention in its open position, with the tear strip being partially torn away.
Figure 3:
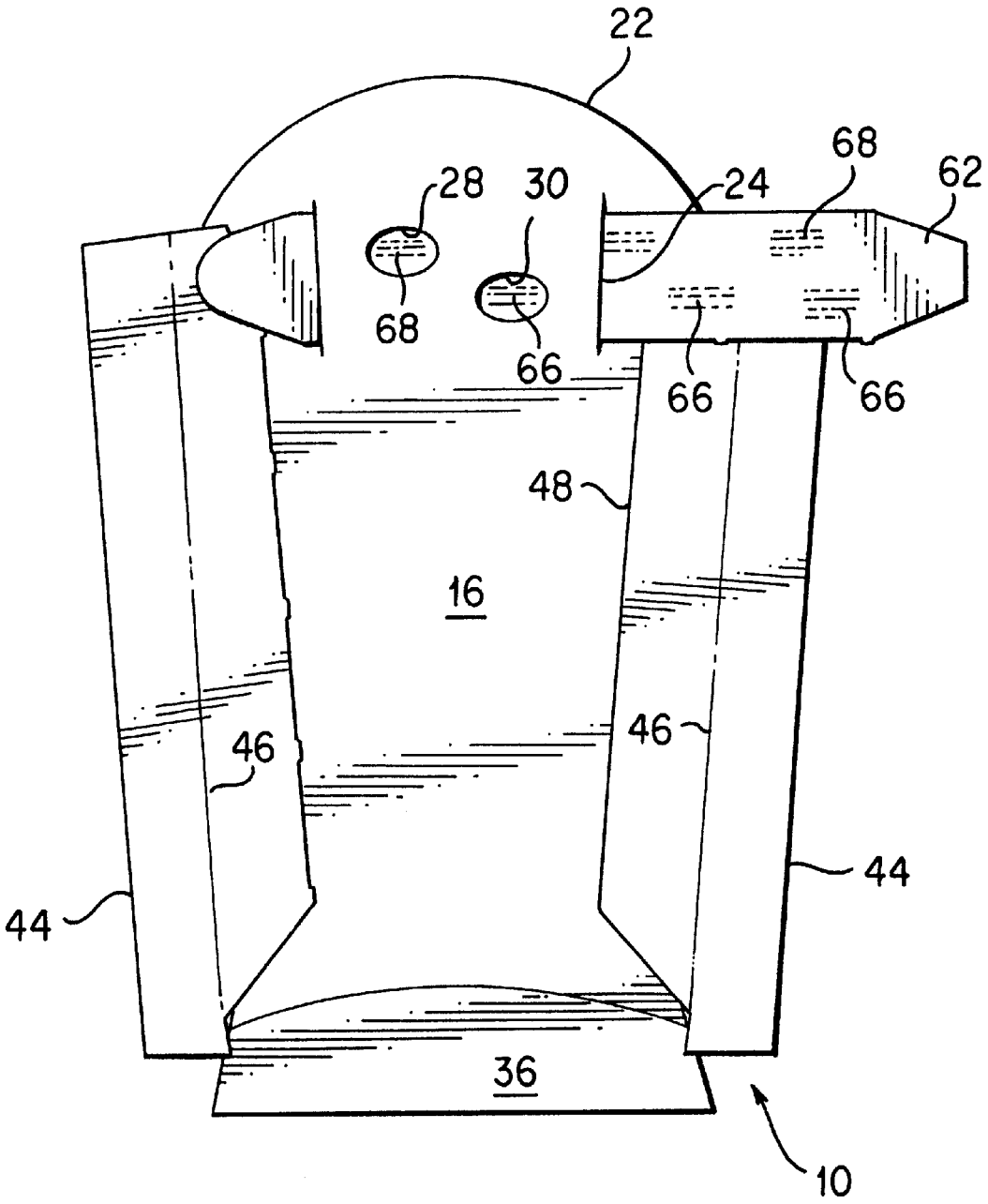
FIG. 3 is a view similar to FIG. 2 and illustrates the tear strip as passing or threaded through two parallel slits, with portions of the indicia of the tear strip being visible through the openings in the rear wall.

FIG. 2 shows the rear of the assembled and glued scoop, with tear strip 62 being partially torn off, and glue panels 50 glued to rear wall 16. Panels 52 and 54 define the sides of the container or scoop, and are squeezed together to open the flattened scoop or container, as is conventional. In FIG. 3, the rear of the scoop is again shown, now with the tear strip completely torn off and inserted into slits 24 and 26. Indicia 66 and 68, printed on tear strip 62, is viewed through openings 28 and 30. One opening may display questions, and the other display corresponding answers, for example. The spacing apart of the two rows of indicia 62, 68 on the tear strip is substantially the same as the vertical spacing between openings 28, 30. The game or quiz may be played whether the scoop is flattened or opened.

Figure 4:
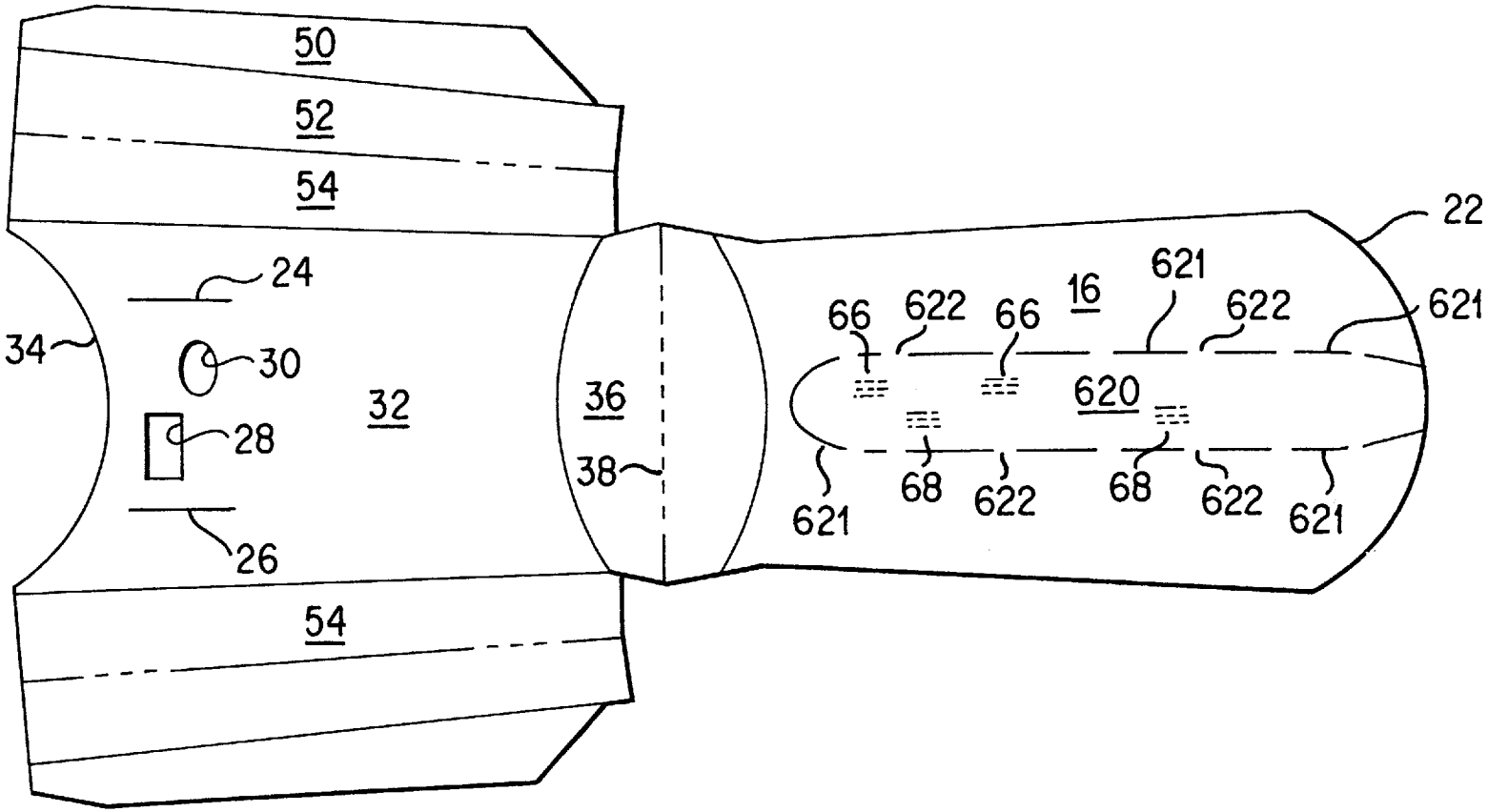
FIG. 4 is a view similar to FIG. 1 and illustrates a second embodiment of a unitary blank for forming a french fry scoop according to this invention.
Figure 5:
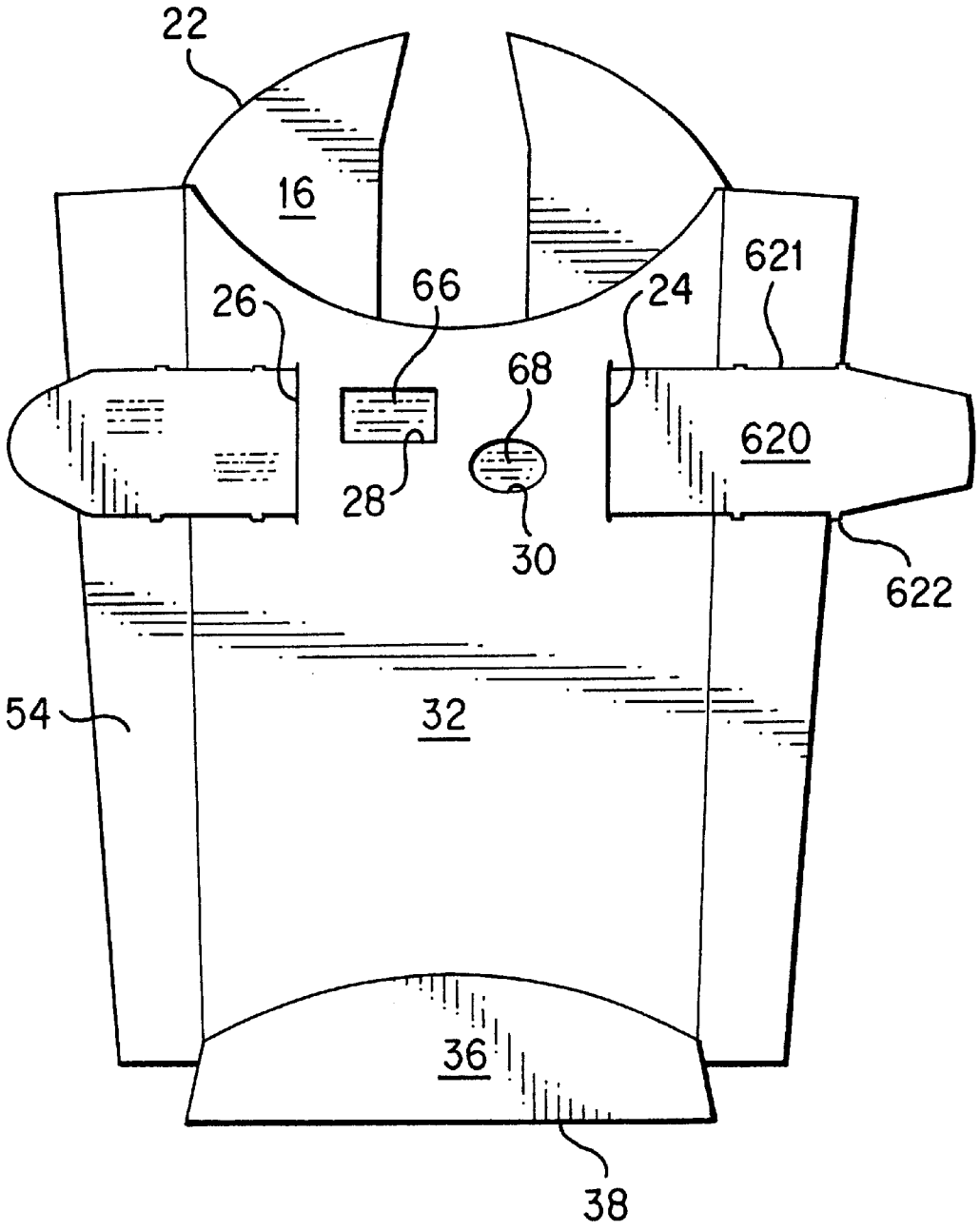
FIG. 5 is a partial view, similar to FIG. 3, of a second embodiment of the invention.

It will be noted that the parallel slits 24 and 26 may be relocated so as to be positioned on front wall 32, instead of on rear wall 16. In that case, openings 28 and 30 would also be relocated to the front wall and also located between the slits. Similarly, tear strip 62 may be relocated to rear wall 16. This second example of the invention is shown at FIGS. 4 and 5, with FIG. 4 showing tear strip 620 (similar to tear strip 62) defined by cut lines 621 separated by land portions 622. Although not illustrated, the blank of FIG. 4 also has an imaginary longitudinal axis similar to axis 12 of FIG. 1. After strip 620 is removed from rear or scoop wall by manually grasping its free, right end and ripping it away from the surrounding paperboard, the scoop is no longer usable to scoop french fries from a basket or other french fry cooker or container. Hence in this embodiment of the invention, the use of the tear strip to define a quiz game substantially destroys the scooping functionality of the scoop. Its use as a game or quiz device is however preserved.

FIG. 5 illustrates strip 620 passing through slits 24 and 26, the latter now located in front wall 32. In both embodiments, it will be noted that the viewing openings 28 and 30 are both vertically and horizontally displaced from each other. After glueing and opening and filling the scoop/container, the scoop is normally held in a vertical orientation, with the bottom wall 36 being its lowest region.

The present scoop is formed in a similar manner as known paperboard french fry scoops, and the practice of this invention in the first embodiment requires only the addition of tear strip 62, with its indicia, and openings 28, 30, and slits 24, 26. In the second embodiment of the invention, only slits 621 need be added, in addition to openings 28, 30, and slits 24, 26. Thus in the second embodiment, no additional paperboard is required, while in the first embodiment, only an amount of paperboard required to define the tear strip 62 is required over conventional paperboard french fry scoops.

What is claimed is:

1. A paperboard container, said container having a closed bottom and an open top, said container adapted to scoop and contain french fries, said container having a front wall and a rear wall, one of said walls having two spaced apart and generally parallel slits, each said slit having a length, one region of one of said walls having at least one opening, said at least one opening located between said slits, a tear strip carried by said container, said tear strip being of generally uniform width, said width being not larger than said length of said slits, indicia carried on at least one surface of said tear strip, whereby said tear strip can be torn off and inserted through said slits, and said indicia viewable through said at least one opening.

2. The container of claim 1 wherein said container and said tear strip is fashioned from a unitary sheet of paperboard.

3. The container of claim 1 including a second opening in one of said front and rear walls, said second opening also located between said slits, said two openings being displaced from each other in a vertical direction, and wherein said indicia is aligned in two parallel rows whose distance apart is substantially the same as the vertical distance apart of said two openings.

4. The container of claim 1 wherein said tear strip is detachably carried by a glue panel glued to said rear wall.

5. The container of claim 1 wherein said tear strip is carried by said rear wall and is a portion of said rear wall.

6. A unitary blank of paperboard, said blank having an imaginary horizontal axis, said blank having left and right portions, one of said portions including a front wall panel, the other of said portions including a rear wall panel, one of said front and rear wall panels having two parallel slits each of substantially the same length, at least one viewing opening between said parallel slits, one of said front and rear wall portions having a tear strip having indicia thereon, said tear strip having a width not greater than said length of said slits.

7. The blank of claim 6 including a second viewing opening between said slits, said two viewing openings being displaced from each other, and wherein said indicia is aligned in two parallel rows whose distance apart is substantially the same as the displaced distance apart of said two openings.

8. The blank of claim 6 wherein said tear strip is carried by a glue panel glued to a rear wall portion of said container.

9. The blank of claim 6 wherein said tear strip is carried by a rear wall portion of said container and is a an integral part of said rear wall portion prior to said tear strip being torn off.

* * * * *